US007562483B2

(12) United States Patent
Hines

(10) Patent No.: US 7,562,483 B2
(45) Date of Patent: Jul. 21, 2009

(54) MODULAR RAIL COVER

(76) Inventor: Steve Hines, P.O. Box 423, Tijeras, NM (US) 87059

( * ) Notice: Subject to any disclaimer, the term of this patent is extended or adjusted under 35 U.S.C. 154(b) by 359 days.

(21) Appl. No.: 11/706,665

(22) Filed: Feb. 12, 2007

(65) Prior Publication Data

US 2008/0190002 A1 Aug. 14, 2008

(51) Int. Cl.
*F41G 1/38* (2006.01)

(52) U.S. Cl. ..... 42/90; 42/96; 42/85; 42/71.01

(58) Field of Classification Search ..... 42/90, 42/96, 85, 71.01
See application file for complete search history.

(56) References Cited

U.S. PATENT DOCUMENTS 5,826,363 A 10/1998 Olson ..... 42/75.01
6,609,321 B2 * 8/2003 Faifer ..... 42/71.01
6,725,594 B2 4/2004 Hines ..... 42/90
6,792,711 B2 9/2004 Battaglia ..... 42/114
2006/0075672 A1 * 4/2006 Romer ..... 42/10

* cited by examiner

*Primary Examiner*—J. Woodrow Eldred
(74) *Attorney, Agent, or Firm*—Richard H. Krukar; Luis M. Ortiz; Kermit D. Lopez

(57) ABSTRACT

A modular rail cover can have rail cover modules and rail cover sections that can be snapped onto or slid onto a mounting rail. Rail cover modules have recoil sockets into which recoil plugs are inserted. The recoil plugs engage recoil grooves such as those in Picatinny type mounting rails to fix the rail cover modules into position. The rail cover sections have section couplers that engage corresponding module couples on the rail cover modules. The section couplers and module couplers lock rail cover sections to rail cover modules. Section couplers can also lock rail cover sections to one another.

20 Claims, 6 Drawing Sheets

MODULAR RAIL COVER

TECHNICAL FIELD

Embodiments relate to the fields of small arms, rifle handguards, carbine handguards, and mounting rails.

BACKGROUND

Current small arms use mounting rail systems for attaching accessories to the small arm. For example, M4 and M16 carbines are often fitted with handguards that incorporate up to four Picatinny rails. Picatinny rails are well known mounting rails that meet the specifications contained in MIL-STD-1913 and MIL-STD-1913 Notice 1. Another mounting rail called the Weaver rail is a notoriously well known variation of the Picatinny rail. Battaglia discloses a mounting rail system in U.S. Pat. No. 6,792,711 while Olson discloses another in U.S. Pat. No. 5,826,363.

FIG. 1, labeled as "prior art", illustrates a handguard 101 with four mounting rails 102 of which three are visible. A number of accessories have been developed to attach to small arms by way of mounting rails 102. The mounting rails have recoil grooves 103 that help lock accessories in place and help users attach accessories in repeatable positions.

FIG. 2, labeled as "prior art", illustrates an M16 rifle 201 with mounting rails 102. The specific rifle is a flat top model having a mounting rail 102 on the upper receiver 202 as well as the four on the handguard. Some other models have upper receivers with carrying handles and integral rear sights. The illustrated firearm has a total of five mounting rails. It is unlikely to find a firearm provisioned with enough accessories to populate every inch of all five mounting rails 102. Furthermore, the handguard 101 is intended to be held by a person's hand. The mounting rails 102 on the handguard 101 can be extremely uncomfortable to hold with a bare hand and can even cause cuts. The recoil grooves 103 also provide an excellent place for mud and other things to collect.

FIG. 3, labeled as "prior art", illustrates a Picatinny type mounting rail 102 viewed from the side. As discussed above the mounting rail has recoil grooves 103 that can help lock rail mounted accessories in place.

Rail covers, such as those disclosed by Hines (U.S. Pat. No. 6,725,594) can be attached to the mounting rails so that the mounting rails are comfortable to grab and so that the recoil grooves do not collect filth. Knight's Armament of Vero Beach, Fla. manufactures rail covers that attach to specially designed mounting rails. The specially designed mounting rails have rail cover lock points as well as the recoil grooves of Picatinny style mounting rails.

Toy replica firearms such as Airsoft toys are pellet firing small arms replicas. Hobbyists enjoy engaging in mock non-lethal battles using toy replica firearms because they are realistic looking and fire non lethal, although often painful, pellets. The realistic toys are also used in small arms training because the toys can have the same weight, size, and accessories as firearms used in combat or police work. The toy replica firearms are often realistic enough that many accessories and rail covers can be attached to small arms and to toy replica firearms. Those practiced in combat training and police training are familiar with toy replica firearms.

Rail covers can be designed to fit, or cut to fit, specific mounting rails. Cut to fit rail covers are prone to slipping around on the mounting rail and occasionally slipping off. Designed to fit rail covers are not suitable for all situations. As such, systems and methods are needed to address shortcomings in the prior art.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

Systems and methods providing a modular rail cover that fixedly attaches to standard mounting rails is needed.

It is therefore an aspect of the embodiments to provide a rail cover module that has a recoil socket. The rail cover module can be placed on a mounting rail such that the recoil socket aligns with a recoil groove. A recoil plug can then be inserted into the recoil socket to fix the rail cover module in place. Once fixed in place, the rail cover module is not free to slide around on the mounting rail. It is advantageous for the recoil plug to snap into place when pressed into the recoil socket.

A rail cover section is, essentially, a rail cover module without a recoil socket. A rail cover section has a section coupler that can attach to a module coupler incorporated into the modular rail cover. As such, a rail cover module can be fixed in place on the mounting rail and a rail cover section can be placed on the mounting rail and fixed to the modular rail cover. In this manner, the rail cover section is also fixed in place on the mounting rail. Section couplers can also be used to attach rail cover sections to one another.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the background of the invention, brief summary of the invention, and detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof. In general, the figures are not to scale.

A modular rail cover can have rail cover modules and rail cover sections that can be snapped onto or slid onto a mounting rail. Rail cover modules have recoil sockets into which recoil plugs are inserted. The recoil plugs engage recoil grooves such as those in Picatinny type mounting rails to fix the rail cover modules into position. The rail cover sections have section couplers that engage corresponding module couplers on the rail cover modules. The section couplers and module couplers lock rail cover sections to rail cover modules. Section couplers can also lock rail cover sections to one another.

Figure 1:
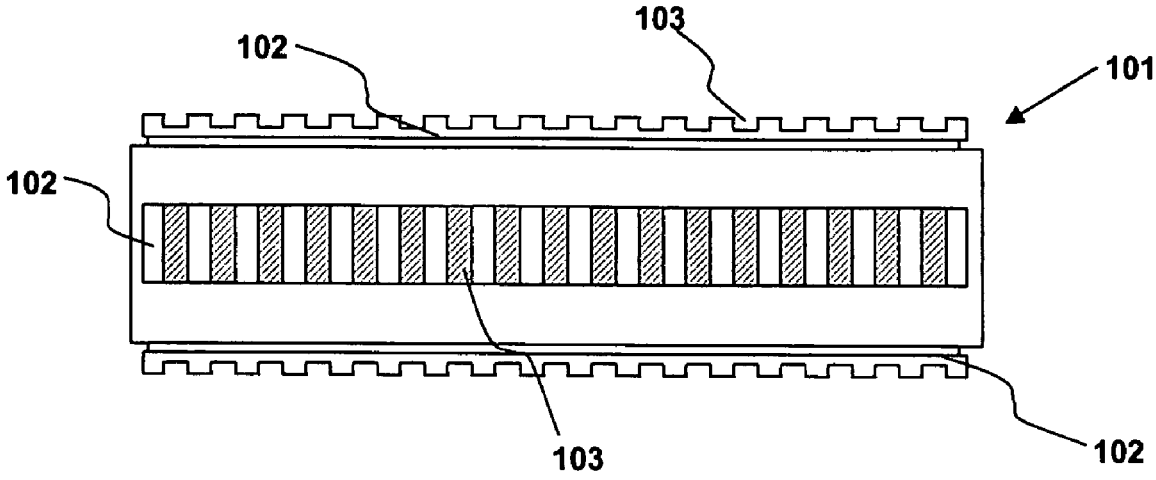
Fig. 1 (Prior Art)
FIG. 1, labeled as "prior art", illustrates a handguard with four mounting rails of which three are visible.
Figure 2:
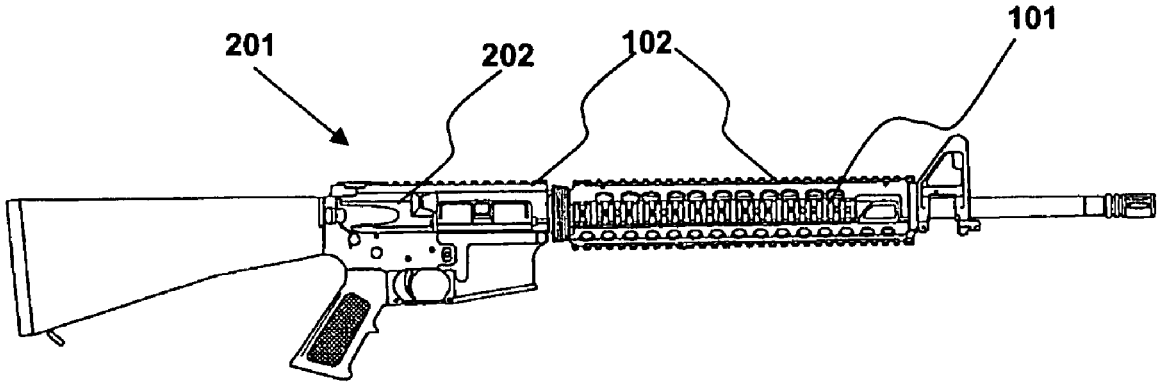
Fig. 2 (Prior Art)
FIG. 2, labeled as "prior art", illustrates an M16 rifle with mounting rails.
Figure 3:
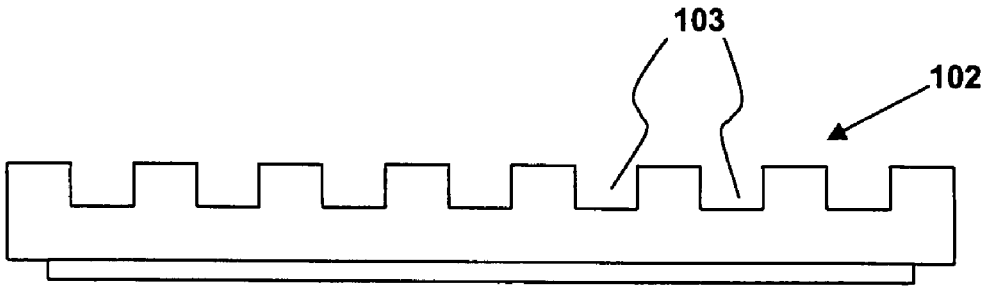
FIG. 3, labeled as "prior art", illustrates a Picatinny type mounting rail viewed from the side.
Figure 4:
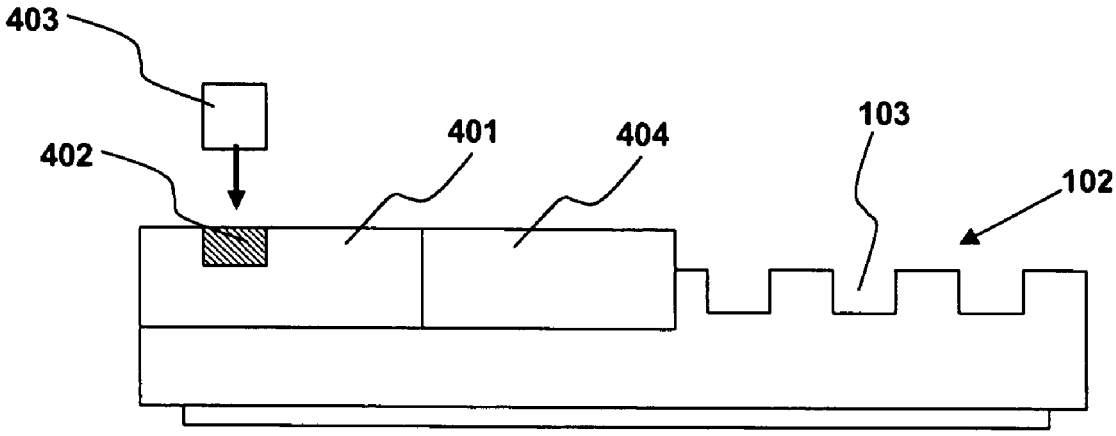
FIG. 4 illustrates a side view of a mounting rail with a rail cover module and a rail cover section in accordance with aspects of the embodiments.

FIG. 4 illustrates a side view of a mounting rail 102 with a rail cover module 401 and a rail cover section 404 viewed from the side in accordance with aspects of the embodiments. The rail cover module 401 can be slid onto or snapped onto the mounting rail 102 and the recoil socket 402 can be aligned with one of the recoil grooves 103. A recoil plug 403 can then be pressed into the recoil socket 402 until it engages the recoil groove 103. The recoil plug 403 locks the rail cover module 401 in place on the mounting rail 102.

A rail cover section 404 can also be slid or snapped onto the mounting rail 102. The main difference between a rail cover section 404 and a rail cover module 401 is that the rail cover section 404 locks into position by coupling to the rail cover module 401. A rail cover module 401 can have module couplers and a rail cover section 404 can have section couplers. The section couplers and the module couplers fit together such that the rail cover section 404 is fixed to the rail cover module 401.

Figure 5:
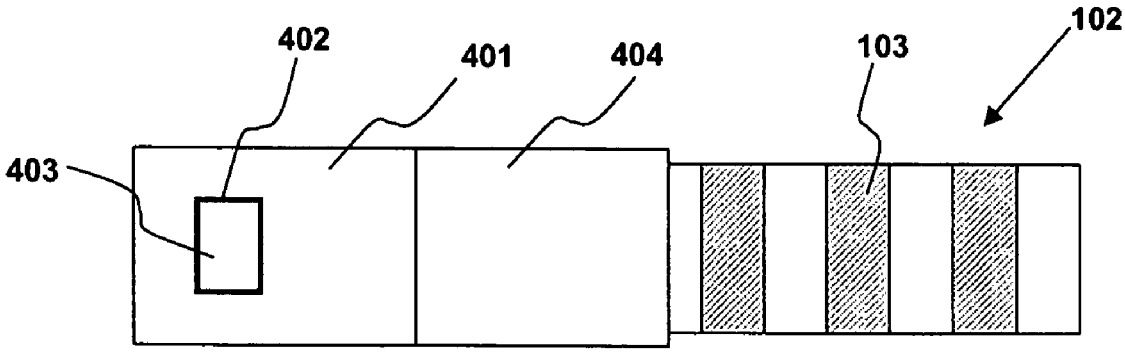
FIG. 5 illustrates a top view of a mounting rail with a rail cover module and a rail cover section in accordance with aspects of the embodiments.

FIG. 5 illustrates a top view of a mounting rail 102 with a rail cover module 401 and a rail cover section 404 in accordance with aspects of the embodiments. The recoil plug 403 has been snapped into the recoil socket 402 to fix the rail cover module 401 and the rail cover section 404 in place on the mounting rail 102. Two parts can be snapped together when they have matching concave and convex spots. For example, a convex spot can be a hemispherical bump and a concave spot can be a hemispherical indent. Pressing the two parts together can cause convex spots to snap into concave spots and thereby snap the parts together. Those skilled in the arts of enclosures or mechanical subassemblies are familiar with parts and subassemblies that snap together.

Figure 6:
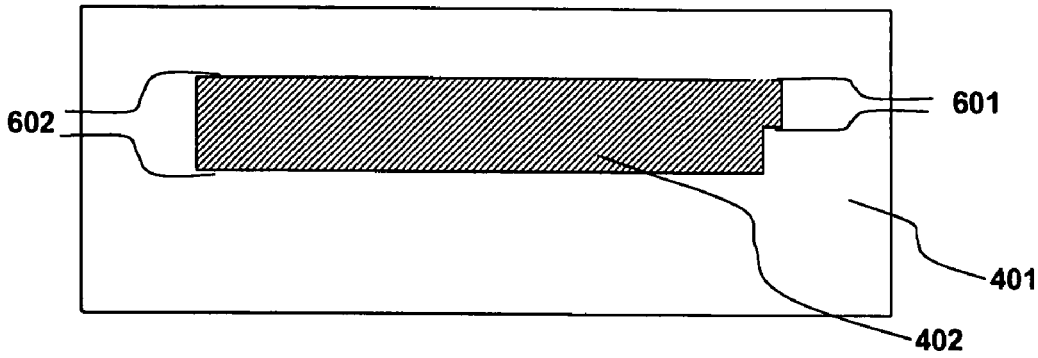
FIG. 6 illustrates a top view of a rail cover module in accordance with aspects of the embodiments.

FIG. 6 illustrates a top view of a rail cover module 401 in accordance with aspects of the embodiments. The rail cover module 401 has a recoil socket 402 with concave spots. The concave spots are not shown because they are on the sidewall of the recoil socket 402. Two concave spots are hinge indents located at hinging points 601 while two other concave spots are latch indents located at latching points 602. A recoil socket can have latch indents and no hinge indents. A latching point is a spot where two parts are intended to be snapped together and then be relatively immobile. A hinging point is a spot where two parts are intended to be snapped together to form a hinge.

Figure 7A:
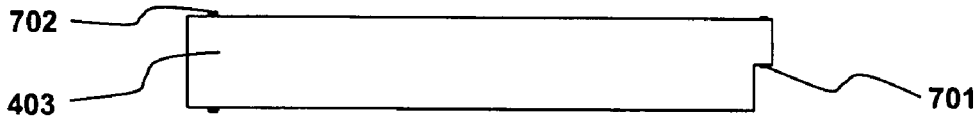
FIG. 7 illustrates a recoil plug in accordance with aspects of the embodiments.
Figure 7B:
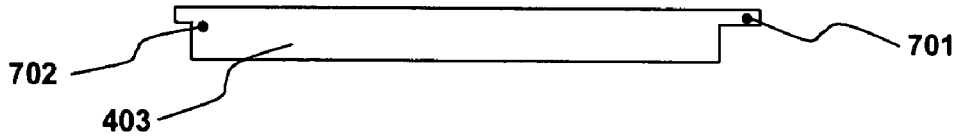

FIG. 7 illustrates a recoil plug 403 in accordance with aspects of the embodiments. The recoil plug has hinge bumps 701 and latch bumps 702. The recoil plug 403 can be pressed into the recoil socket such that all the bumps snap into their respective indents. Alternatively, the recoil plug can be pressed in the recoil socket on one end so that the hinge bumps 701 engage the hinge indents to form a hinge.

Figure 8:
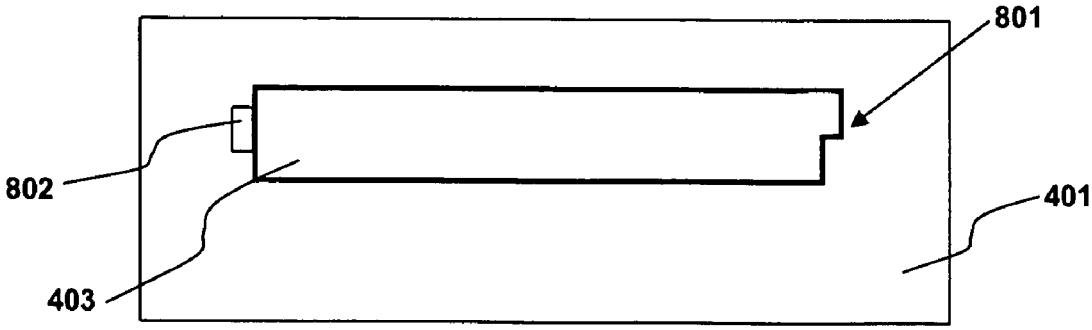
FIG. 8 illustrates a top view of a rail cover module with a recoil plug in accordance with aspects of the embodiments.

FIG. 8 illustrates a top view of rail cover module 401 with a recoil plug 403 in accordance with aspects of the embodiments. The recoil plug 403 is fully pressed into the recoil socket to form a hinge 801 and to latch the recoil plug 403 in place. A pry point 802 is an indented area where a tool or finger nail can be inserted to pry up the end of the recoil plug 403 and thereby disengage the latch bumps from the latch indents. A recoil plug and recoil socket can be designed to have hinge points on both sides so that unhinging one side allows the recoil plug to hinge on the other side while engaging both sides causes the recoil plug to be latched down into the recoil socket.

Figure 9:
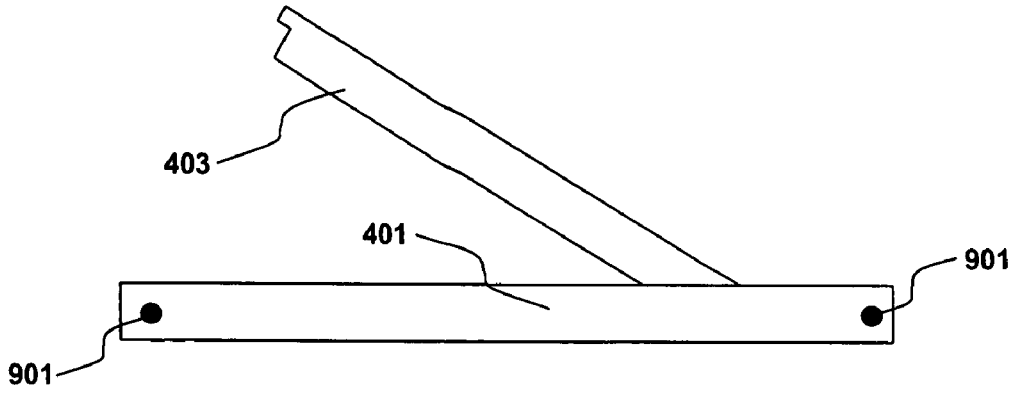
FIG. 9 illustrates a side view of a rail cover module with a recoil plug in accordance with aspects of the embodiments.

FIG. 9 illustrates a side view of rail cover module 401 with a recoil plug 403 in accordance with aspects of the embodiments. The recoil plug 403 is attached to the rail cover module 401 by a hinge, but is not latched down. As such, the rail cover module can be slid on a mounting rail. The recoil plug 403 can be unhinged by pulling it away from the rail cover module 401. The recoil plug 403 as illustrated can also be unhinged by misaligning it to a recoil groove and then pressing down on the end opposite from the hinge. The rail cover module 401 also has module couplers 901.

Figure 10:
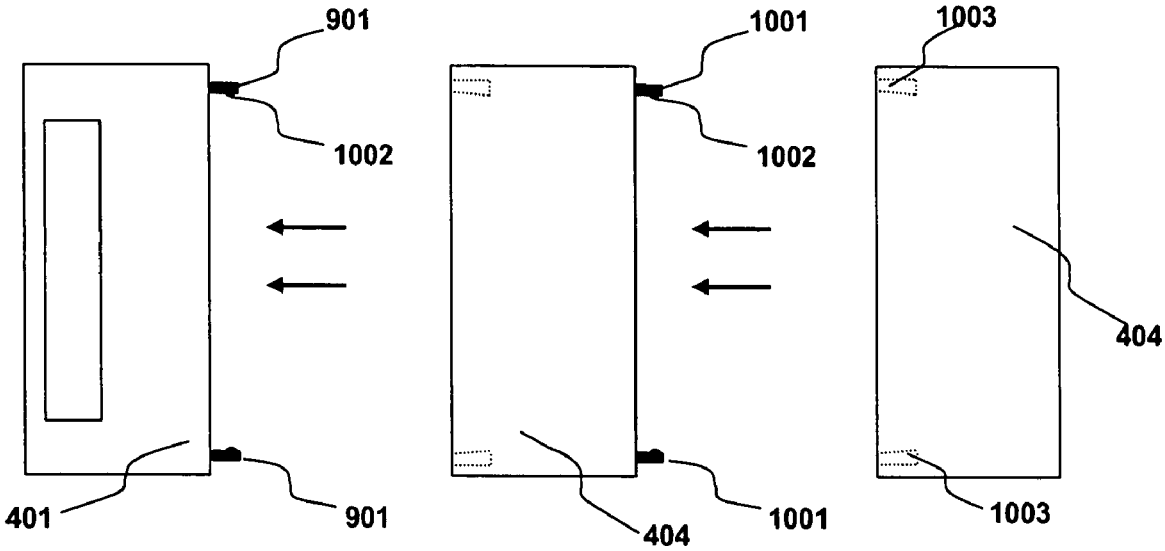
FIG. 10 illustrates a rail cover module and rail cover sections in accordance with aspects of the embodiments.

FIG. 10 illustrates a rail cover module 401 and rail cover sections 404 in accordance with aspects of the embodiments. The module couplers 901 are designed to lock into section couplers 1003. The module couplers 901 can have hemispherical bumps 1002 so that they more firmly lock in place when pressed into the section couplers 1003. Some of the section couplers are holes into which the module couplers can be pressed. The holes are illustrated as tapered although straight sidewalls can also be used. Other section couplers 1001 are similar to the module couplers 901 so that rail cover sections can be joined end to end.

Figure 11:
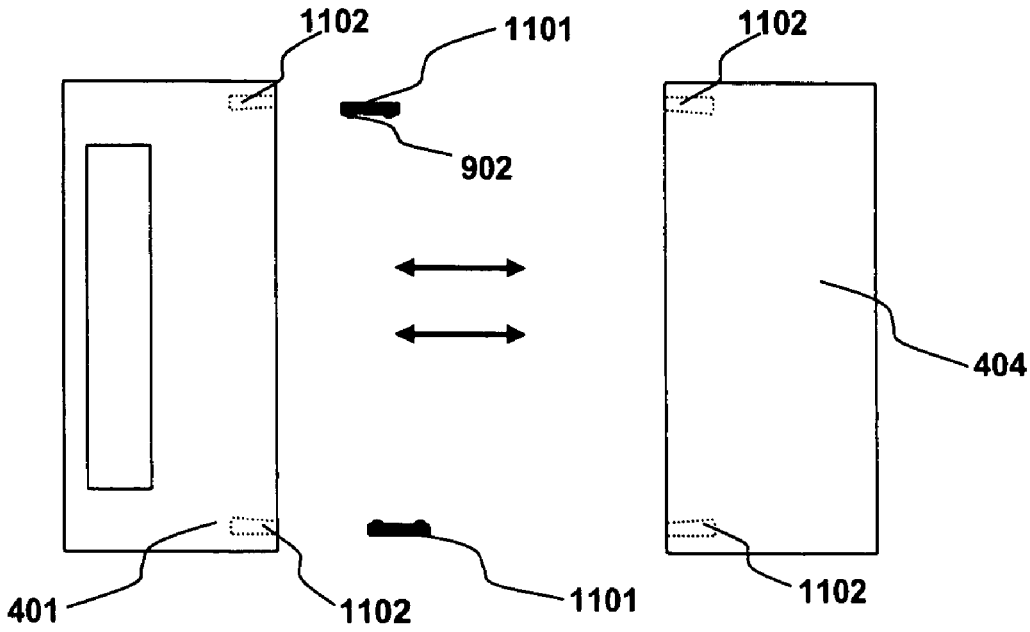
FIG. 11 illustrates a rail cover module and a rail cover section in accordance with aspects of the embodiments.

FIG. 11 illustrates a rail cover module 401 and a rail cover section 404 in accordance with aspects of the embodiments. Both the rail cover module 401 and the rail cover section 404 have holes 1102 similar to the section couplers 1003 of FIG. 10. The holes 1102 act as section couplers and as module couplers. The rail cover module 401 and the rail cover section can be joined by pressing them together with connectors 1101 engaging the holes 1102.

Figure 12:
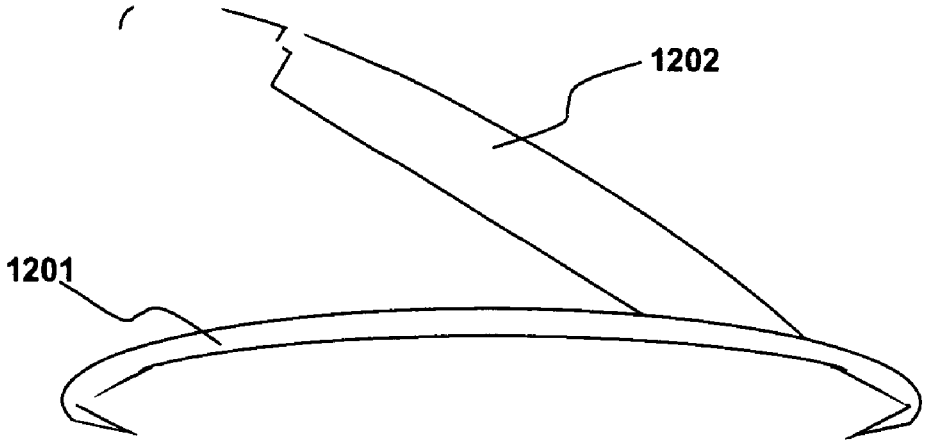
FIG. 12 illustrates a curved rail cover module and a curved recoil plug in accordance with aspects of the embodiments.

FIG. 12 illustrates a curved rail cover module 1201 and a curved recoil plug 1202 section in accordance with aspects of the embodiments. The rail cover modules and recoil plugs of FIGS. 4-11 are idealized to more easily show aspects of the embodiments. Curved rail covers produce a more comfortable hand grip. Curved rail covers can also be snapped onto a mounting rail by pressing them down onto the mounting rail because the curved section flattens and the sided get further apart. As such, a rail cover module 1201 can be snapped onto a mounting rail. A curved recoil plug 1202 matches the curved profile of the curved rail cover module 1201.

Figure 13:
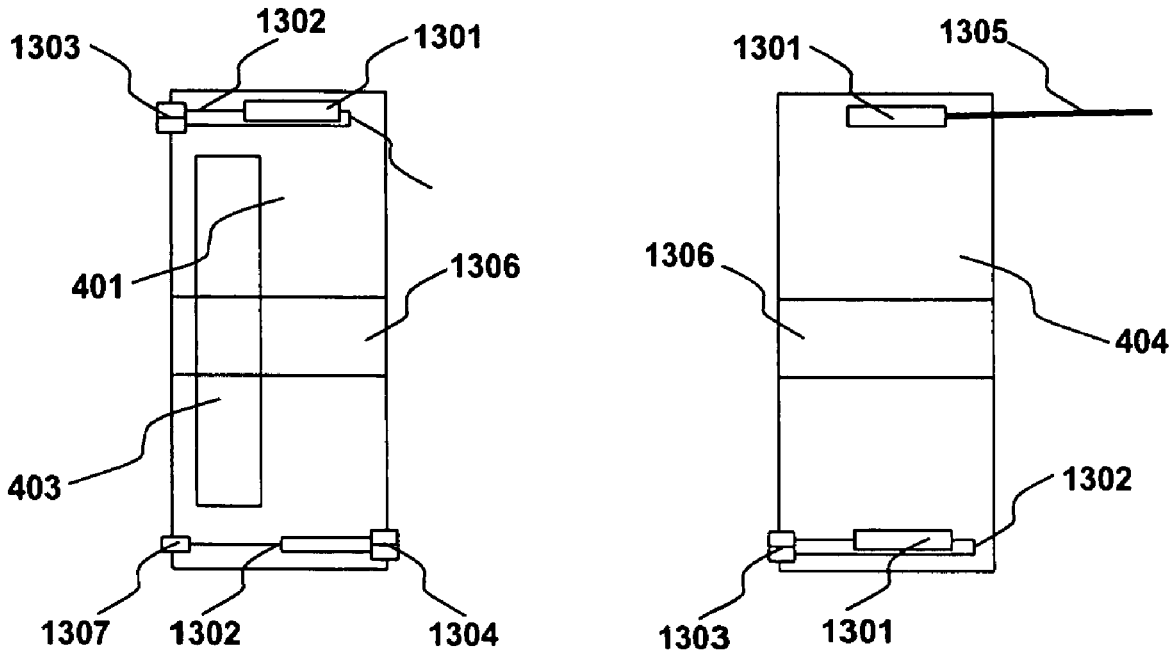
FIG. 13 illustrates a top view of a rail cover module and a rail cover section with switches and accessory grooves in accordance with aspects of certain embodiments.

FIG. 13 illustrates a top view of a rail cover module 401 and a rail cover section 404 with switches 1301 and accessory grooves 1306 in accordance with aspects of certain embodiments. Switches, connectors, and wires can be attached to or incorporated into rail cover modules 401 or rail cover sections 404. Electrical current or voltage present at a connector 1303 and passing along a wiring path 1302 can be controlled by a switch 1301. Wires 1305 can alternatively be wired directly to a switch 1301. Pass through wiring can accept an electrical current or voltage at a connector 1307 then passes it along a wiring path 1302 to a mating connector 1304. A mating connector 1304 can connect to a connector 1303 so that a switch 1308 is electrically connected to the connector 1307. Electrical connections, switches, wires, wiring, and wiring paths are well known to those practiced in the art of electrical circuitry.

Many of the well known switches can be used such as slide switches, rocker switches, and pressure sensitive switches. Pressure sensitive switches are switches that open or close only while pressed.

Figure 14:
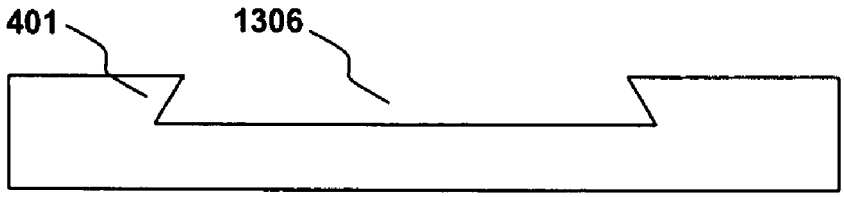
FIG. 14 illustrates an end view of a rail cover module with an accessory groove in accordance with aspects of certain embodiments.

FIG. 14 illustrates an end view of a rail cover module 401 with an accessory groove 1306 in accordance with aspects of certain embodiments. An accessory groove 1306 can provide an attachment point for accessories having a matching form. For example, the accessory groove can be designed to mate to a Picatinny rail. As can be seen in FIG. 13, the accessory groove can be formed into the rail cover module 401, rail cover section 404, and recoil plug 403.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A system comprising:

a rail cover module comprising a recoil socket; and a recoil plug;

wherein a mounting rail comprises at least one recoil groove; and wherein the recoil plug plugs into the recoil socket and engages the at least one recoil groove to fix the rail cover module to the mounting rail.

2. The system of claim 1 wherein a firearm comprises the mounting rail.

3. The system of claim 2 wherein a hinge engages the recoil plug to the rail cover module such that the recoil plug rotates on the hinge to plug into the recoil socket and engage the recoil groove.

4. The system of claim 3 wherein rotating the recoil plug into the recoil socket when the recoil socket and the at least one recoil groove are misaligned disengages the recoil plug from the rail cover module.

5. The system of claim 2 wherein pressing the recoil plug into the recoil socket results in the in the recoil plug snapping into position such that the recoil plug cannot freely disengage from the recoil groove.

6. The system of claim 2:

wherein pressing the recoil plug into the recoil socket results in the in the recoil plug snapping into position;

wherein the recoil plug cannot freely disengage from the recoil groove when snapped into position; and wherein snapping the recoil plug into position forms a hinge connecting the recoil plug to the rail cover module.

7. The system of claim 2 further comprising:

a module coupler and a rail cover section comprising a section coupler; and wherein the module coupler and the section coupler engage to join the rail cover module and the rail cover section end to end.

8. The system of claim 1 wherein the mounting rail is a Picatinny rail.

9. The system of claim 1 wherein a toy firearm replica comprises the mounting rail.

10. A method comprising:

providing a rail cover module comprising a recoil socket;

wherein a mounting rail comprises at least one recoil groove;

wherein inserting a recoil plug into the recoil socket when the recoil socket is aligned to the at least one recoil groove locks the rail cover module in place on the mounting rail.

11. The method of claim 10 wherein the mounting rail is a Picatinny rail.

12. The method of claim 10 wherein a firearm comprises the mounting rail.

13. The method of claim 10 wherein a toy firearm replica comprises the mounting rail.

14. The method of claim 10 further comprising:

providing a rail cover section comprising a section coupler;

wherein the rail cover module further comprises a module coupler; and wherein the module coupler and the section coupler engage to join the rail cover module and the rail cover section end to end.

15. The method of claim 14 wherein a hinge engages the recoil plug and the rail cover module such that the recoil plug rotates on the hinge to plug into the recoil socket and engage the recoil groove.

16. A system comprising:

a rail cover module comprising a module coupler;

a rail cover section comprising a section coupler;

wherein a mounting rail comprises at least one recoil groove; and wherein the module coupler and the section coupler engage to join the rail cover module and the rail cover section end to end.

17. The system of claim 16 wherein the mounting rail is a Picatinny rail.

18. The system of claim 16 wherein a firearm comprises the mounting rail.

19. The system of claim 16 wherein a toy firearm replica comprises the mounting rail.

20. The system of claim 16 further comprising a recoil plug;

wherein the rail cover module further comprises a recoil socket; and wherein the recoil plug plugs into the recoil socket and engages the at least one recoil groove to fix the rail cover module to the mounting rail.

* * * * *